US010239670B2

(12) United States Patent
Snow et al.

(10) Patent No.: US 10,239,670 B2
(45) Date of Patent: Mar. 26, 2019

(54) NO SPILL CAP ASSEMBLY

(71) Applicants: Gary Lee Snow, Rock Falls, IL (US); Chad Edward Aulwes, Sterling, IL (US)

(72) Inventors: Gary Lee Snow, Rock Falls, IL (US); Chad Edward Aulwes, Sterling, IL (US)

( * ) Notice: Subject to any disclaimer, the term of this patent is extended or adjusted under 35 U.S.C. 154(b) by 0 days.

(21) Appl. No.: 14/942,869

(22) Filed: Nov. 16, 2015

(65) Prior Publication Data

US 2016/0137361 A1 May 19, 2016

Related U.S. Application Data

(60) Provisional application No. 62/123,422, filed on Nov. 18, 2014, provisional application No. 62/179,006, filed on Apr. 27, 2015.

(51) Int. Cl.

| | |
|---|---|
| ***B65D 51/18*** | (2006.01) |
| ***B65D 47/26*** | (2006.01) |
| ***B65D 47/24*** | (2006.01) |
| *B65D 43/02* | (2006.01) |

(52) U.S. Cl.

CPC ..... *B65D 47/261* (2013.01); *B65D 47/243* (2013.01)

(58) Field of Classification Search

CPC .. B65D 47/261; B65D 47/265; B65D 47/263; B65D 47/268; B65D 47/12; B65D 41/0492; B65D 51/18; B65D 2251/0025; B65D 2251/0028; B65D 2251/0087; B65D 2251/009

USPC ..... 220/253, 25.3, 259.49, 259.3, 259.4

See application file for complete search history.

(56) References Cited

U.S. PATENT DOCUMENTS

| | | | | |
|---|---|---|---|---|
| 4,718,570 | A * | 1/1988 | Diener | B65D 47/265 220/253 |
| 5,785,213 | A * | 7/1998 | Guillot | B65D 47/263 215/250 |
| 6,615,473 | B2 * | 9/2003 | McClean | B65D 43/169 215/321 |
| 7,785,537 | B2 * | 8/2010 | Ohashi | B01L 3/50825 215/235 |
| 7,799,284 | B2 * | 9/2010 | Ohashi | B01L 3/50825 215/235 |
| 8,251,263 | B2 * | 8/2012 | DeMarco | B65D 51/18 220/253 |
| 8,613,893 | B2 * | 12/2013 | Ohashi | G01N 35/1079 220/252 |
| 8,813,987 | B2 * | 8/2014 | Oelz | B65D 47/2018 220/253 |
| 2008/0142519 | A1 * | 6/2008 | Chou | B65D 43/0202 220/253 |

(Continued)

*Primary Examiner* — J. Gregory Pickett
*Assistant Examiner* — Niki M Eloshway

(57) ABSTRACT

A cap assembly connected to a container for dispensing the contents of the container includes an inner cap and an outer cap. The inner cap includes a cylindrical inner cap surface between a proximal end and a distal end that includes an inner cap opening. The outer cap is positioned over and secured to the inner cap. The outer cap includes a cylindrical outer cap surface between the proximal end and distal end, and the cylindrical outer cap surface includes an outer cap opening. The cap assembly includes an open configuration and a closed configuration. The outer cap can be rotated about the inner cap between the open configuration and the closed configuration.

17 Claims, 6 Drawing Sheets

(56) References Cited

U.S. PATENT DOCUMENTS

| | | | | |
|---|---|---|---|---|
| 2010/0018975 | A1* | 1/2010 | DeMarco | B65D 47/265 220/253 |
| 2013/0062347 | A1* | 3/2013 | Webster | G01F 11/46 220/253 |
| 2013/0180988 | A1* | 7/2013 | Clark | B65D 47/265 220/253 |

* cited by examiner

NO SPILL CAP ASSEMBLY

CROSS-REFERENCE TO RELATED APPLICATIONS

This application claims the benefit of U.S. Provisional Application No. 62/123,422, filed Nov. 18, 2014, and U.S. Provisional Application No. 62/179,006, filed Apr. 27, 2015, which are herein incorporated by reference in their entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

Conventional bottle cap designs are removed from the container and the user must aim or use a funnel when the bottle is turned upright to dispense fluids. Even with the use of a funnel, accidental spills happen due to improper aiming or while dispensing fluids on a windy day, thus causing fluids to spray throughout the engine compartment.

What is needed is a cap design that minimizes accidental spills while dispensing fluids. In addition, a cap design that eliminates the need for a separate funnel while dispensing fluids is needed.

SUMMARY

Briefly, and in general terms, various embodiments are directed to a cap for use with a bottle that is designed to minimize accidental spills while dispensing fluids. In one embodiment, a dispensing cap connected to a container for dispensing the contents of the container includes an inner cap having a proximal end and a distal end. The proximal end of the inner cap includes a proximal opening and the distal end of the inner cap includes an inner cap opening. The inner cap may also include a locking groove disposed in its surface. Further, the dispensing cap also includes an outer cap that is positioned over and secured to the inner cap. The outer cap has a proximal end and a distal end. The proximal end of the outer cap includes a proximal opening and the distal end of the outer cap includes an outer cap opening. In one example, the outer cap housing includes a locking arm that protrudes inside the outer cap, and the locking arm engages the locking groove disposed on the surface of the inner cap.

In this embodiment, the dispensing cap includes an open configuration and a closed configuration. The outer cap may be rotated about the inner cap between the open configuration and the closed configuration. In the open configuration, the inner cap opening at least partially overlaps the outer cap opening allowing the contents of the container to be dispensed through the dispensing cap. In the closed configuration, the inner cap opening does not overlap the outer cap opening, and instead, a sealing surface of the inner cap blocks or seals off the outer cap opening.

In one embodiment, the inner cap and outer cap both include a generally circular shaped cross-section. The inner cap and the outer cap may have the same or similar shape, such that the inner cap fits within and complements the inner surface of the outer cap. Further, the inner cap has a smaller cross section than the outer cap housing. In one embodiment, the inner cap opening is smaller than the outer cap opening. The inner cap opening, however, may be the same or substantially the same size as the outer cap opening. The sealing surface of the inner cap is inversely proportional to the smaller inner cap opening. The sealing surface of the inner cap should span across the entire outer cap opening so that the sealing surface of the inner cap closes the outer cap opening and prevents the contents of the container from escaping the container.

In one embodiment, the inner cap has a generally cylindrical shape and the inner cap opening is disposed at least partially on the cylindrical side of the inner cap and at the distal end. The outline of the opening may be crescent shaped. Also, the outer cap has a generally cylindrical shape and the outer cap opening is disposed at least partially on the cylindrical side of the outer cap and at least partially at the distal end of the outer cap. The shape of the inner cap opening and the outer cap opening may be substantially the same. However, in other embodiments, the shape of the inner cap opening may differ from the shape of the outer cap opening.

In certain embodiments, the inner cap opening and outer cap opening is generally funnel shaped. In other embodiments, only the outer cap opening is funnel shaped. The shapes of the inner cap opening and the outer cap opening may differ depending on the desired pour from the container. For example, the outer cap may be shaped like a spout.

In order to attach the dispensing cap on the container, the inner cap includes a threaded cylindrical portion that attaches to a threaded portion of the container. In this way, the dispensing cap may be attached to and removed from a variety of containers. The size of the threaded cylindrical portion can vary to fit the threaded portion of the container.

To attach the outer cap with the inner cap, the inner cap may include a radial rib and the outer cap may include a groove that snaps over the radial rib of the inner cap. Other means to attach and secure the outer cap to the inner cap may be employed in other embodiments.

In another embodiment, a cap assembly connected to a container for dispensing the contents of the container includes an inner cap and an outer cap. The inner cap includes a proximal end and a distal end, with the proximal end including a proximal opening. Also, the inner cap includes a cylindrical inner cap surface between the proximal end and distal end. In this embodiment, the cylindrical inner cap surface includes an inner cap opening. The outer cap is positioned over and secured to the inner cap in this embodiment. The outer cap includes a proximal end and a distal end, with the proximal end including a proximal opening. Also, the outer cap includes a cylindrical outer cap surface between the proximal end and distal end, and the cylindrical outer cap surface includes an outer cap opening.

In this embodiment, the cap assembly includes an open configuration and a closed configuration. The outer cap can be rotated about the inner cap between the open configuration and the closed configuration. In the open configuration, the inner cap opening at least partially overlaps the outer cap opening allowing the contents of the container to be dispensed through the cap assembly. In the closed configuration, the outer cap is rotated about the inner cap such that the inner cap surface blocks the outer cap opening.

In certain embodiments, the inner cap and outer cap both include a circular cross-section adjacent the proximal ends of the inner cap and outer cap. The inner cap opening may be disposed at least partially on the cylindrical inner cap surface and at least partially on the distal end of the inner cap. Also, the outer cap opening is disposed at least partially on the cylindrical outer cap surface and at least partially on the distal end of the outer cap.

In yet another embodiment, there is disclosed a dispensing cap connected to a container for dispensing the contents of the container. The dispensing cap includes an inner cap having a proximal end and a distal end. The proximal end includes a proximal opening and the distal end includes a distal opening. In this embodiment, the inner cap includes a cylindrical inner cap surface between the proximal end and distal end, and the cylindrical inner cap surface includes a groove. The dispensing cap also includes an outer cap that is positioned over and secured to the inner cap. The outer cap includes a proximal end and a distal end. The proximal end has a proximal opening and the distal end has at least one distal opening. The outer cap also includes a cylindrical outer cap surface between the proximal end and distal end. This embodiment of the dispensing cap also includes a seal attached to the outer cap near the at least one distal opening of the outer cap. There is also a spring disposed between the inner cap and the outer cap. The spring biases the outer cap away from the inner cap such that the seal completely covers the at least one distal opening of the outer cap to place the dispensing cap in a closed configuration.

To place the dispensing cap in an open configuration of this embodiment, the outer cap is pressed against the spring such that the seal no longer completely covers the at least one distal opening of the outer cap. In this configuration, contents of the container are allowed to exit. In one example, the distal end of the outer cap may have a funnel shape. The shape of the outer cap may take any shape desired to pour contents of the container.

Other features and advantages will become apparent from the following detailed description, taken in conjunction with the accompanying drawings, which illustrate by way of example, the features of the various embodiments.

DETAILED DESCRIPTION

Figure 1:
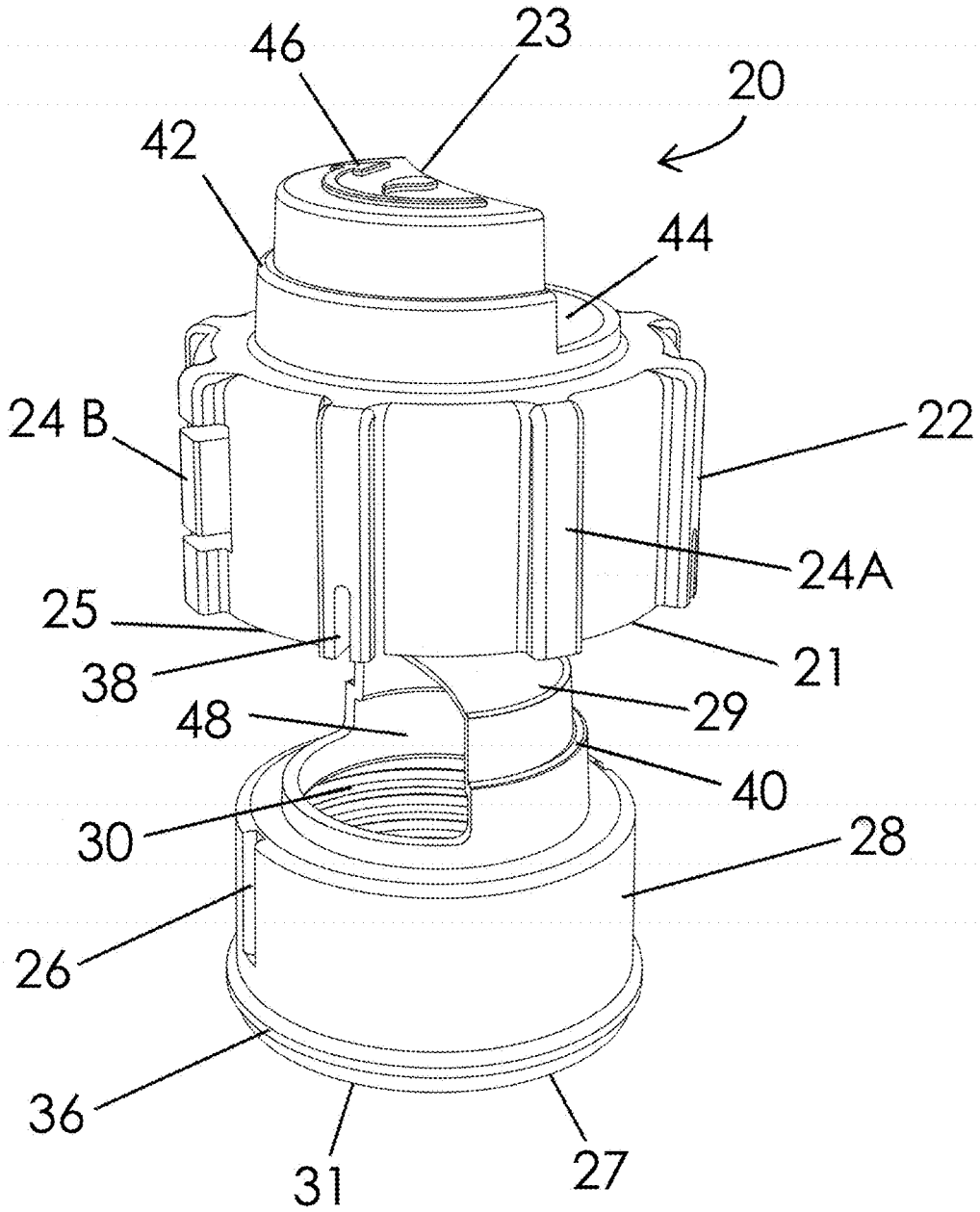
FIG. 1 is a exploded view of one embodiment of a twist and pour cap.

Referring now to the drawings, wherein like reference numerals denote like or corresponding parts throughout the drawings and, more particularly to FIGS. 1-14, there are shown various embodiments of a no spill cap assembly. The various embodiments of the no spill cap assembly are used with a bottle to minimize accidental spills while dispensing various fluids or solids. By way of example only, the no spill cap assembly can be used to dispense any fluid, including oil, detergent, anti-freeze, windshield washer fluid, brake fluid, hand soap, multi-purpose cleaners, or any other types of fluid. Also, the no spill cap assembly can be used to dispense solids from a bottle or container, including salt, sand, various types of pellets or granular substance, powder crystals, beads and the like.

A ratcheting or dispensing cap 20 is shown in FIG. 1. The dispensing cap 20 includes an outer cap 22 positioned over an inner cap 28. The outer cap 22 has a proximal end 21 and a distal end 23. The proximal end includes a proximal opening 25. The outer cap 22 also includes a plurality of vertical ribs 24A. The vertical ribs 24A allow a user to easily grab and twist the outer cap. Any number of vertical ribs 24A can be positioned on the circumference of the outer cap 22. In other embodiments, the outer cap 22 may include a combination of rubber texture, soft touch dimples, or depression that would allow a user to easily grab and twist the outer cap. In the embodiment shown in FIG. 1, at least one of the vertical ribs 24A include grooves 38 with one end open, but not all vertical ribs 24A may include grooves 38. The size and shape of the groove 38 may vary.

The outer cap 22 also includes at least one ratchet or locking arm 24B. The inside shape of locking arms 24B (not shown) has one or more protrusions extending into the inner portion of the outer cap. As shown in the figures, there may be two locking arms 24B. At least one end of the locking arm 24B is fixed or moulded onto the side skirt of outer cap 22, such that the locking arm 24B is flexible or moveable with respect to the outer cap 22. The three remaining sides of locking arms 24B have slots to allow for flexing into grooves on an inner cap, which will be described below. As shown best in FIG. 3, there may be two locking arms 24B attached to the outer cap 22. In other embodiments, there may be one or any plurality of locking arms; however, two locking arms 24B are preferred.

The outer cap 22 includes a funnel top 42 having an opening 44 allowing fluids to be dispensed into a vessel without unwanted spills. In one embodiment, the opening is partially on the side of the funnel top 42 and partially on the distal end 23 of the funnel top 42. It has been contemplated that the opening can be on entirely on the side of the funnel top or entirely at the distal end of the funnel top. In other embodiments, the size and shape of the funnel 42 may vary to accommodate various containers for proper dispensing of like fluids or solids. In other funnel embodiments, the size of the funnel 42 may vary and the shape of the funnel 42 may vary from stepped, rounded, scalloped and may have provisions of a telescopic spout or tube at the distal end 23 of the cap assembly 20. By way of example only, the opening 44 shape of funnel 42 has an approximately 170 degree opening with respect to the circumference of the distal end of the cap assembly or crescent shape and size to mesh with opening 48 of an inner funnel 40 on the inner cap 28, allowing fluids or solids to be dispensed from a container. Positioning the openings in a closed configuration, the cap assembly 20 can be closed or sealed off by rotating the outer cap 22 in a 180 degree clockwise position. The opening 48 on the inner cap 28 is approximately the same size of the opening 44 on funnel 42 of cap 22. However it has been contemplated that the opening 48 of inner cap 28 is smaller than the opening 44 on funnel 42 of outer cap 22. The openings 44 and 48 can vary between approximately 1 degree and approximately 180 degrees, and in other embodiments can be less than 360 degrees with respect to the circumference of the outer and inner caps, respectively. In a closed configuration, the outer cap 22 is rotated such that its 180 degree or less opening is covered by a sealing surface 41 of inner cap 28, which in one embodiment, covers 180 degrees or more of the circumference of the inner cap 28.

Fluids and solids can be dispensed from cap assembly 20 when outer funnel opening 44 and the inner funnel opening 48 are aligned in an open configuration. In the open configuration, the outer cap 22 is rotated about the inner cap 28 until the openings 44 and 48 at least partially overlap one another. In other embodiments, the crescent shape opening 44 allows for proper sealing of funnel 42 when the inner cap 28 is rotated such that the sealing surface 41 of the inner cap covers the entire opening 44. When finished dispensing the contents of a container, e.g., fluids or solids, any contents not dispensed from a container can then be sealed off by rotating the outer cap 22 such that the sealing surface 41 of the inner cap 28 seals off the outer funnel opening 44. The size and shape of inner funnel 40 and outer funnel 42 can be that of beaded, stepped, rounded, scalloped and also may have provisions of a telescopic spout or tube protruding from the cap assembly 20.

Figure 5:
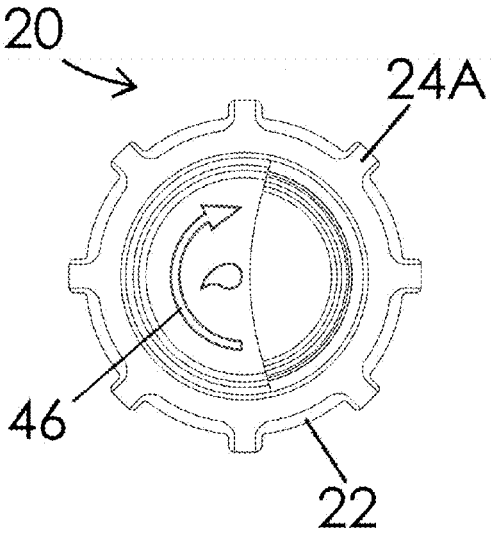
FIG. 5 is a top view of the twist and pour cap in a closed position.

Indicators, words, or symbols can be applied to the outer cap 22 top surface to show the type of fluids or solids being dispensed from a container. By way of example only, an oil droplet indicia can be disposed on the outer cap 22, as best shown in FIG. 5, to indicate an oil bottle.

Figure 2:
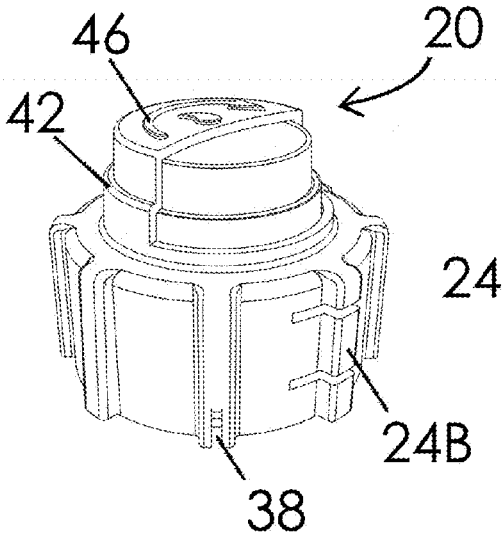
FIG. 2 is a perspective view of one embodiment of a twist and pour cap in a closed position.
Figure 3:
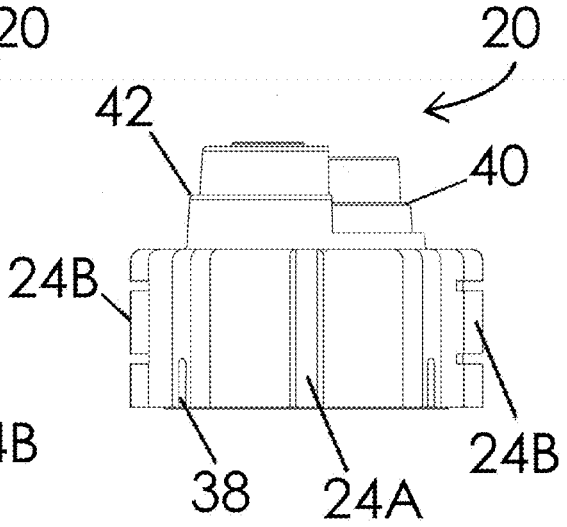
FIG. 3 is a side view of the twist and pour cap in a closed position shown in FIG. 2.
Figure 4:
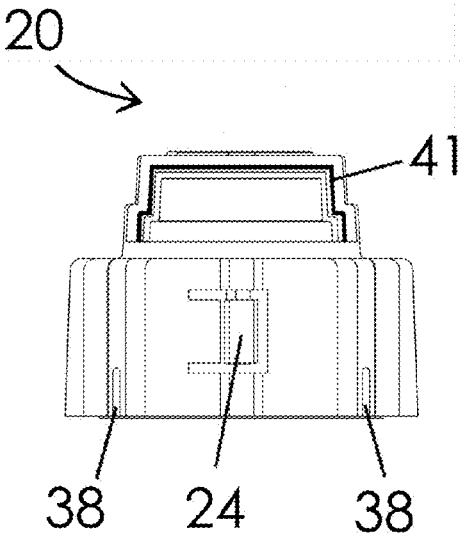
FIG. 4 is a side view of the twist and pour cap in an open position.
Figure 6:
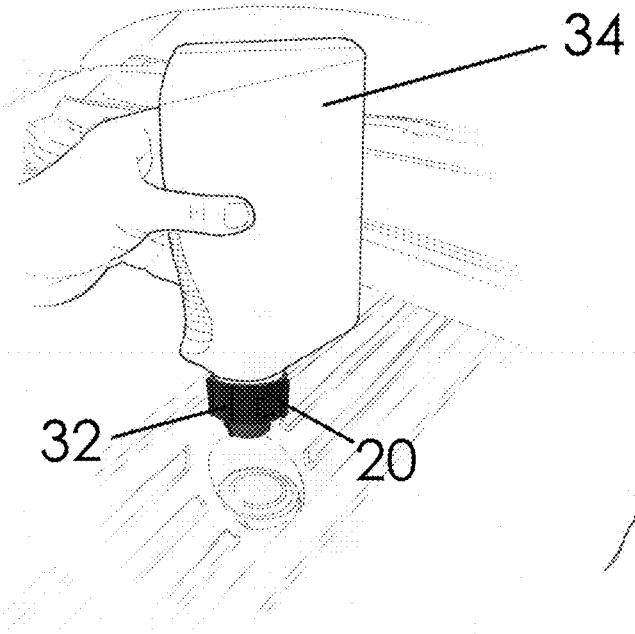
FIG. 6 depicts one embodiment with a user holding an oil container with a no spill cap in a closed position.

The dispensing cap 20 also includes an inner cap 28 having a proximal end 27 and a distal end 29. The proximal end of the inner cap includes a proximal opening 31. The outer shape of the inner cap 28 maybe the same or similar to the inside shape of outer cap 22 to allow for proper fit, form, and function of cap assembly 20. The inner cap 28 may include an inner threaded cylindrical body or skirt 30 for allowing attachment to an open upper end 32 of a container 34 as shown in FIG. 6. In this embodiment, the inner cap 28 includes ratchet arm or locking vertical grooves 26 and a radial rib 36. The circumference of the inner cap 28 is less than the circumference of the outer cap 22 so that the outer cap can be fitted over the inner cap. The thread size and dimensions of the assembled cap 20 are determined by the thread size of any container subjected for use. The inner cap 28 also includes an opening 48 at the distal end. The opening 48 is approximately 170 degrees but can vary between 1 and 180 degrees, and in other embodiments may be less than 360 degrees. It is preferred that the inner opening 48 is equal to or smaller than the opening 44 of the outer cap 22 to ensure a tight seal when the cap assembly 20 is in a closed configuration. A sealing surface 41 formed of the top surface and side steps of funnel 42 blocks the opening 44 of the outer cap 22 as shown in FIGS. 2 and 3. As shown in FIG. 4, the sealing surface may be rubberized or include an over molded seal to ensure a proper seal when the cap assembly is in the closed configuration. In another embodiment, the inside distal surface of the outer cap 22 may be rubberized or include an over molded seal. When the outer cap is rotated to the open configuration, such that the openings 44 and 48 at least partially overlap each other, fluids or solids may be dispense from the opening of the cap assembly 20.

The cap assembly 20 is secured by pressing radial rib 36 of inner cap 28 into an inner groove inside that is around the inner circumference of the outer cap 22. In other embodiments, the outer cap may be secured to the inner cap by tongue and groove, beaded snap, screw(s) or by bayonet configurations. Grooves 38 on outer cap 22 allow the cap skirt to flex allowing the radial rib 36 to connect or properly seat to the inside groove of outer cap 22. Once the outer cap 22 is placed over the inner cap 28, the outer cap 22 can be rotated until the locking arms 24B lock into the ratchet arm grooves 26. When the cap assembly 20 is in the closed configuration as shown in FIGS. 2 and 3, the opening 44 of the outer cap is sealed off by sealing surface 41 of the inner cap 28. When the outer cap 22 is rotated about the inner cap as shown in FIGS. 4 and 5, the outer cap 22 opening 44 is aligned with the inner cap 28 opening 48, thus allowing fluids or solids to be dispensed from a container. The outer cap funnel 42 opening 44 may be rotated such that the openings only partially overlap one another to achieve the desired opening for controlling the flow of fluids or like mediums from a container. Indicia may be provided on the cap indicating the flow rate or the size of the opening. Once enough torque is applied to the outer cap, the locking arms 24B will flex out of the vertical grooves 26 of the inner cap 28, which allows the outer cap to rotate.

In one embodiment, an over moulded seal 41 as shown in FIG. 4 may be disposed on the inner surface of the outer cap or the outer distal surface of the inner cap to prevent any fluids from leaking from the container when the cap assembly is in a closed position. Other materials or combinations of materials including an O-ring, gasket, bead snap feature, foil, or the like may be used to prevent fluids from leaking from the container. The closed position of the cap assembly is secured by the means of locking arms 24B engaged with vertical grooves 26 on inner cap 28. Combinations of snaps, tab locks, push and engage, and child lock embodiments could be incorporated into the cap assembly as other safety features to secure the opening of the cap assembly. Ratchet/locking arms 24B can also be used to remove the cap assembly 20 from a container. With the vertical locking arms 24B on outer cap 22 engaged into the vertical grooves 26 on inner cap 28. Applying force to the vertical locking arms 24B, the user may now rotate the outer cap about the inner cap to disengage the threaded cylindrical body of the inner cap 28 from the threaded container 34 of the bottle.

Figure 8:
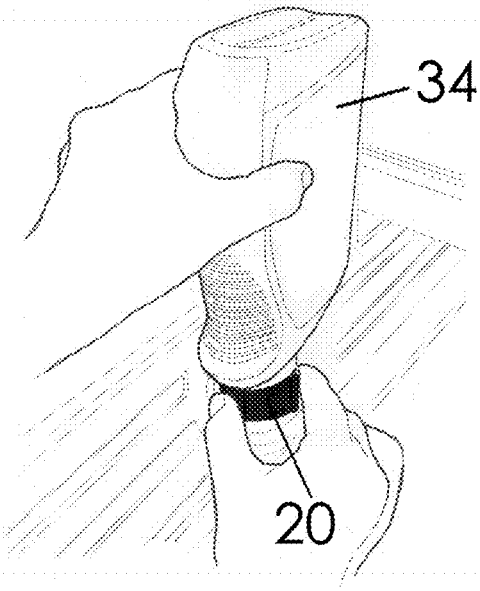
FIG. 8 depicts a user holding a container with the no spill cap in an open position allowing oil to be dispensed into the reservoir.
Figure 7:
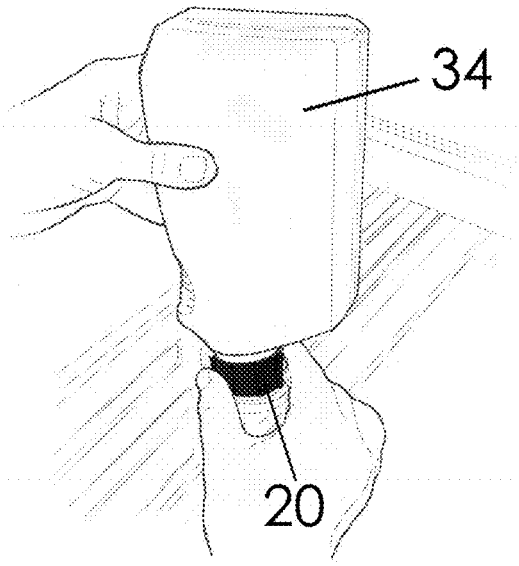
FIG. 7 depicts the user holding the oil container with the no spill cap positioned and ready to pour oil into a reservoir of an automobile engine.

By way of example only, a method of using the dispensing cap 20 with an oil container will be described. It should be understood that the dispensing cap 20 can be used in the same manner with other types of containers and various types of liquids or solids. As shown in FIG. 6, the dispensing cap assembly 20 is positioned on the upper end 32 of an oil container 34. With the dispensing cap 20 secured on the container 34 in the closed position, a user may place the container cap assembly 20 and container 34 in an inverted position so that the dispensing cap is positioned near or in a fluid filler hole. As shown in FIG. 7, to begin dispensing oil, the user grabs the vertical ribs 23 of the outer cap 20 and twists the outer cap 22 about the inner cap 28 to place the cap in the open configuration such that the openings 44 and 48 of both the outer cap 22 and inner cap 28 are aligned. If a partial dispensing of fluid is desired, the outer cap 22 can be rotated to adjust the overlap of the openings 44 and 48 to a desired opening size to control flowing of fluid or solids. As shown in FIG. 8, the outer cap 22 can be rotated in both the clockwise and anti-clockwise direction to close off the cap. In one embodiment, multiple vertical grooves 26 can be positioned around the inner cap to lock the locking arms 24B of the outer cap 22 in different positions such that the overlap of the outer opening 44 and the inner opening 48 varies depending on the desire of the user. The container 34 can then be removed from the reservoir filler hole without any fluid spillage of use of a separate funnel. The dispensing cap 20 will keep any remaining oil sealed in the container for future use. If the oil container 34 is empty, the user may remove the dispensing cap assembly 20 from the container as described above for use on another oil container with the same internal thread size.

In another embodiment, a push dispensing cap 50 allowing fluid to be dispensed without spillage is shown in FIGS. 9-14. The push dispensing cap 50 includes an outer cap 52 having a proximal end 53 and a distal end 55. The proximal end includes a proximal opening 57. The outer cap 52 also including various vertical ribs 62. The vertical ribs 62 allow a user to easily grab and twist the outer cap 52 into position for dispensing fluids or solids. Any number of vertical ribs 62 can be disposed on the circumference of outer cap 52. In other embodiments, the outer cap 52 may include a combination of rubber texture, soft touch dimples or depression that would allow a user to easily grab and twist the outer cap.

Figure 9:
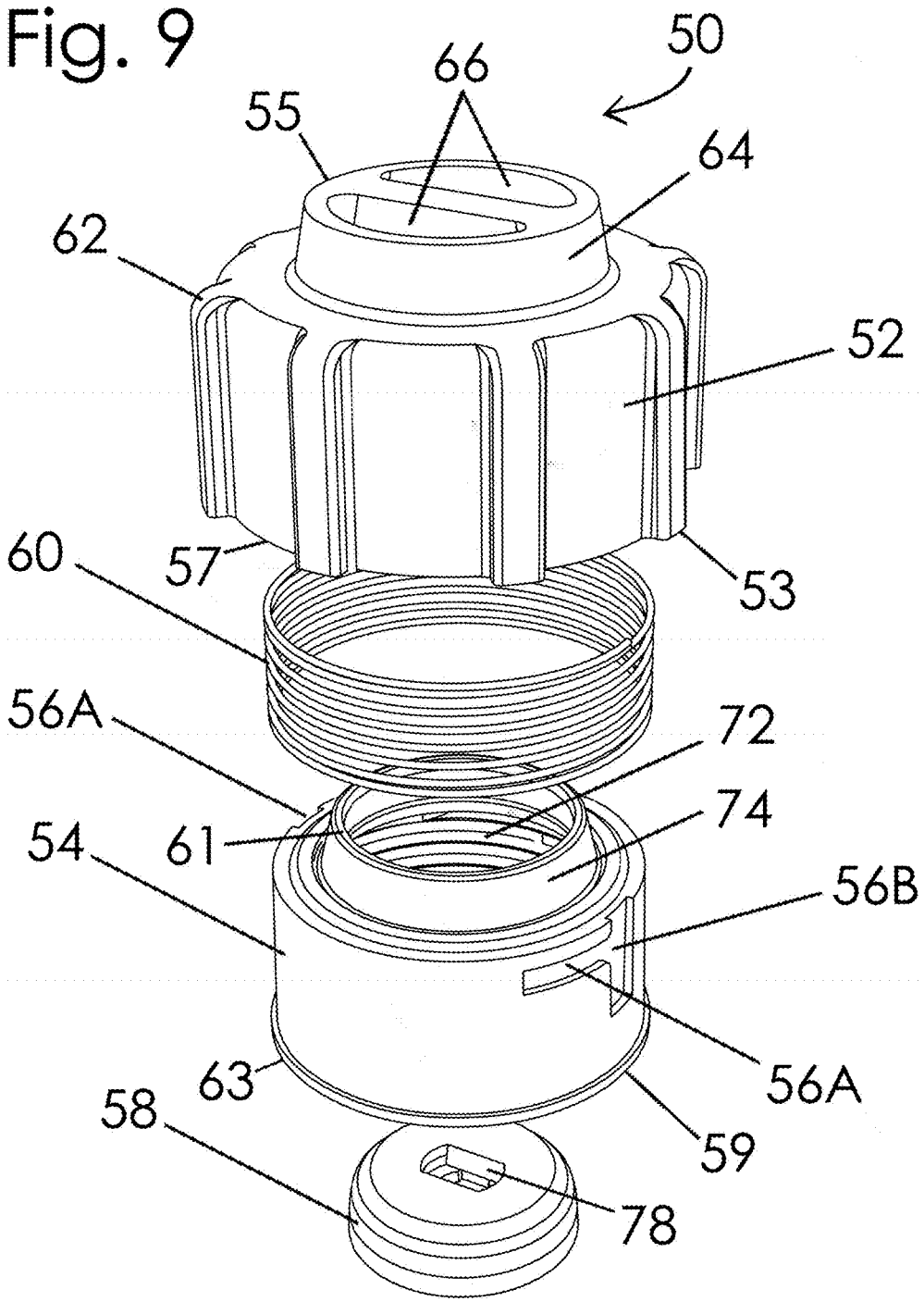
FIG. 9 is an exploded view of one embodiment of a push and pour cap.
Figure 14:
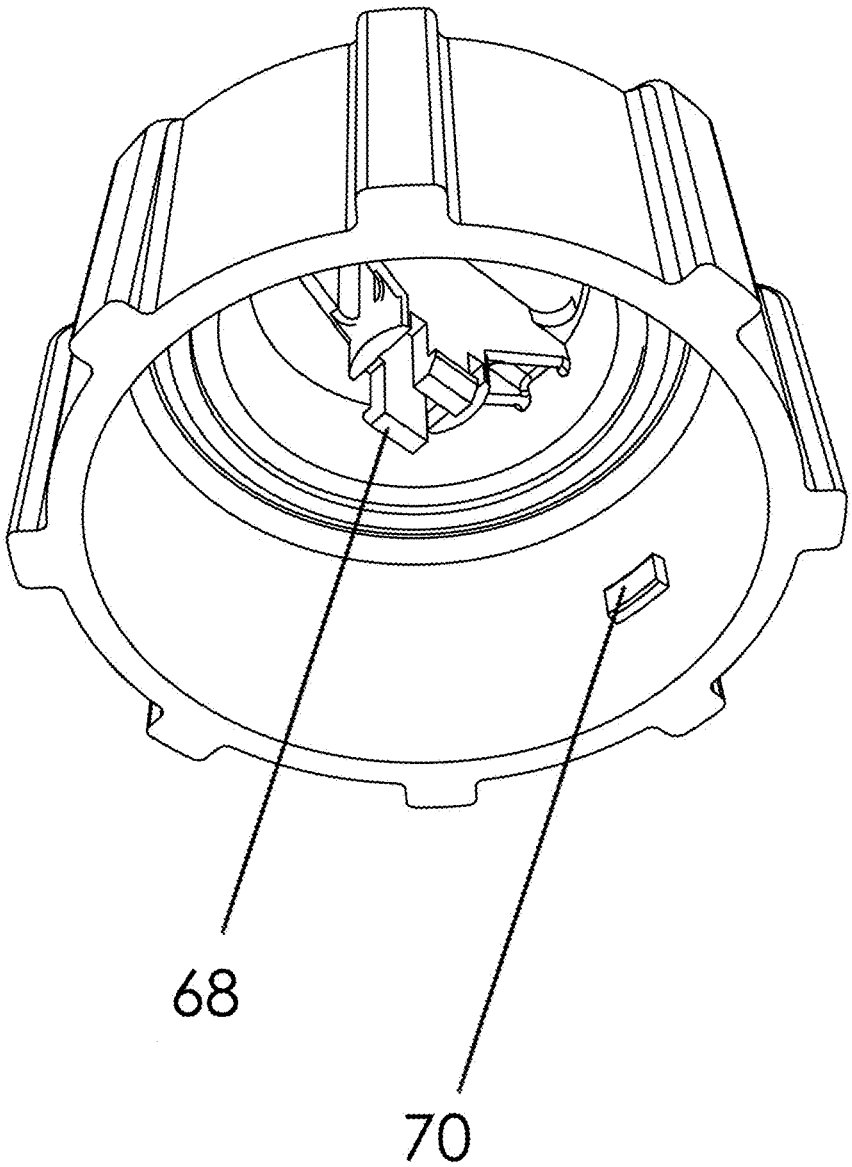
FIG. 14 is a perspective view of an outer cap of one embodiment of the push and pour cap depicting features for retaining the internal components.

In one embodiment, the outer cap 52 includes inner ribs 70 as shown in FIG. 14. Inner ribs 70 may be any shape and its size may vary and is used to help position the assembled cap 50 into an open or closed state, as described in detail below. The outer cap 52 includes a generally cylindrical shape 64 with a step portion at one end as shown in FIG. 9. In other embodiments, the outer cap may have other shapes, such as a funnel cone shape. The top or step portion of the outer cap 52 has a generally funnel shape 64 that is primarily used for dispensing fluids into a vessel without unwanted spills. The funnel portion 64 has openings 66 to allow fluids or solids to be dispensed when the dispensing cap 50 is in an open configuration position. The size and shape of funnel 64 can be that of a bead, step, round, or scallop configuration. Openings 66 can vary in shape depending on the shape and size of container used for dispensing fluids or like mediums. Further, the number of openings 66 may vary from one to a plurality such as six or more openings.

In one embodiment, a seal 58 is positioned and secured (e.g., snapped) onto retaining arms 68 (FIG. 14) of the outer cap. By way of example only, the retaining arms 68 of the outer cap 52 snaps into an opening 78 of the seal. In one embodiment, the seal 58 is a rubber seal that has a diameter large enough to seal against the inside collar surface 76 on the distal end 61 of the inner cap 54. In general, the rubber seal 58 completely seals off the openings in a closed configuration. In one embodiment, rubber seal 58 can break away from the inside sealing surface 76 of the inner cap by pressing the outer cap 52 in a downward position. When the outer cap 52 is pressed down, the rubber seal 58 will move or break away from the inside sealing surface of collar 76, thus allowing fluids or solids to pass through openings 66 of outer cap 52.

As shown in FIG. 9, the push dispensing cap 50 includes an inner cap 54 having an inner threaded cylindrical body or skirt 72. The inner cap 54 includes a proximal end 59 and a distal end 61. The proximal end includes a proximal opening 63. Similar to cap 20, the inner cap 54 of the push dispensing cap 50 attaches to the open upper end 32 of a container 34 as shown in FIG. 6. The outer shape of the inner cap 54 should complement the inside shape of outer cap 52 to allow for proper fit, form, and function of cap assembly 50. The inner cap 54 also includes a horizontal groove 56A and a vertical groove 56B in one embodiment. As shown in FIG. 9, the horizontal groove in in contact with or is open to the vertical groove. As shown in the figures, the horizontal and vertical grooves 56A and 56B form an L-shape, however the grooves may form T-shape together. In another embodiment, the inner cap may only include a vertical groove without a horizontal groove.

Figure 13:
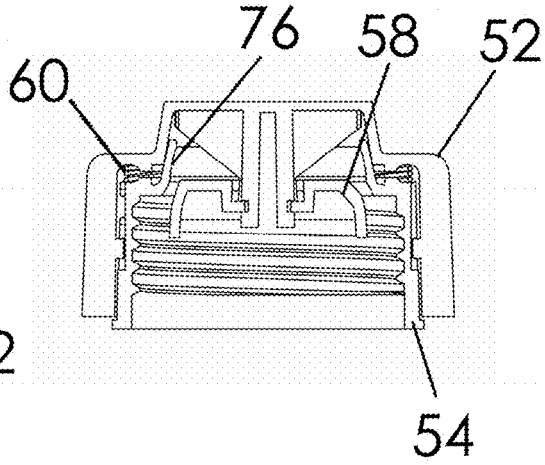
FIG. 13 is a cross section view of an outer cap of one embodiment of the push and pour cap depicting a sealing feature in an open configuration.

The inner rib 70 of the outer cap 52 fits within the groove 56A and 56B and the horizontal groove prevents the outer cap 52 from moving toward or away from the inner cap 54, essentially locking the dispensing cap into a closed configuration. The horizontal groove 56A allows the outer cap 52 to rotate about the inner cap 54 to reach the vertical groove 56B. Once in the vertical groove 56B, the outer cap is allowed to move toward the inner cap 54 and into an open configuration when force is applied to the outer cap that overcomes the force of a spring 60, which is disposed between the inner cap and the outer cap. The cap assembly 50 is in a closed configuration when inner rib 70 is positioned in the horizontal groove 56A. The horizontal locking groove 56A of inner cap 54 prevents the cap assembly from dispensing fluid. The vertical groove 56B of inner cap 54 allows the outer cap 52 and seal 58 to be moved in an opened position allowing fluids or solids to be dispensed. Rotating the outer cap toward the vertical groove 56B allows the inner rib 70 to slide into the vertical 56B groove, allowing the inner rib to slide downward into the vertical groove. By way of example only, pushing the outer cap 52 in a downward motion, seal 58 will separate from the inner cap 54 sealing surface 76 allowing for a open configuration as shown in FIG. 13. This open configuration allows fluids or solids to pass through the inside embodiment of inner cap 54, allowing fluids or solids to pass through both openings 66 of funnel 64.

Figure 10:
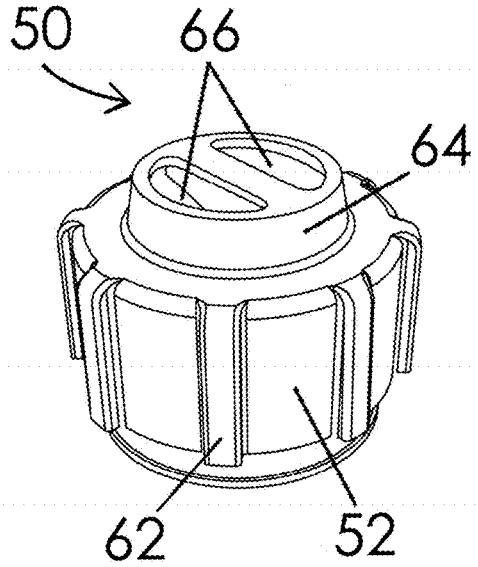
FIG. 10 is a perspective view of one embodiment of a push and pour cap in a closed position.
Figure 11:
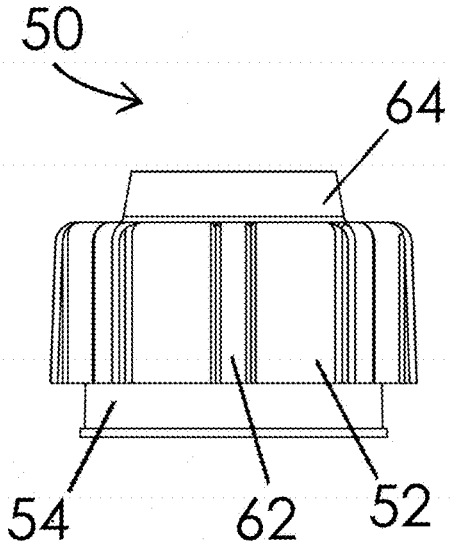
FIG. 11 is a side view of the push and pour cap shown in FIG. 10.
Figure 12:
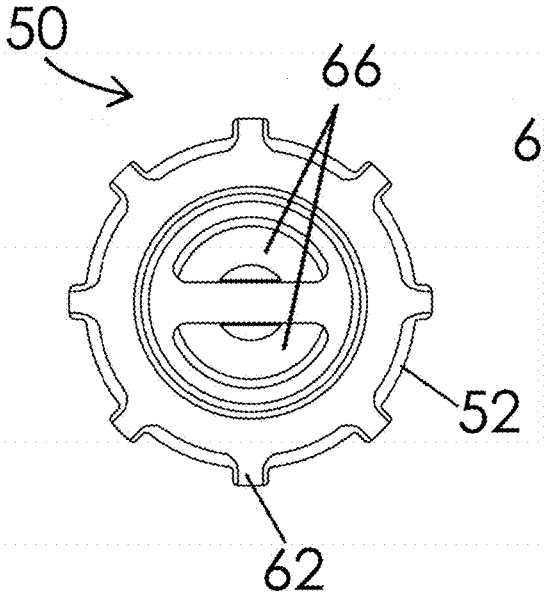
FIG. 12 is a top view of the push and pour cap shown in FIG. 10 in a closed position.

Also, the push dispensing cap 50 includes a compression spring 60 allowing the outer cap 52 to return to the original closed state when pressure is released from the outer cap 52. The inner cap 54 includes a collar 74 to help seat the spring 60 between the outer and inner caps. To fully secure the cap assembly 50, both the spring 60 and inner cap 54 are positioned and placed inside of the outer cap 52. The cap assembly is then fully secured and ready for dispensing fluids. FIGS. 10 through 12 illustrate the cap assembly 50 in a closed assembled state.

Dispensing fluid from a container begins by twisting the cap assembly in a clockwise rotation to align the internal rib 70 of outer cap 52 with the vertical groove 56B of inner cap 54. With the fluid container in an up-side down position, funnel 64 of the cap assembly 50 is placed into the filler hole and push down on fluid container 34 to begin dispensing fluids or solids. When a downward force is applied to the outer cap 52, the spring 60 is compressed allowing the seal 58, which is connected to the retaining arms 68, to break its seal from the inside collar sealing surface. Contents of the container flow around the outside circumference of seal 58 passing through funnel 64 openings 66, allowing the contents of the container to exit the container and cap assembly. Once the desired amount of fluid is dispensed, flowing of fluid can be stopped by releasing pressure to the cap assembly 50. By way of example only, seal 58 returns back to a closed position state sealing off outer surface of seal 58 to inside surface of funnel 76. This condition will prevent fluids or solids from dispensing through openings 66 of the cap assembly 50. Unused fluid in container can then be stored by twisting the outer cap in the anti-rotation direction to lock and seal the cap assembly 50.

The purpose of the above embodiments is to replace existing style container caps. The main focus of this cap design is to eliminate unwanted spillage while dispensing liquid, such as automotive products, food products, household cleaners, and household chemicals, and the like. (as examples only, and not by way of limitation) such as motor oil, antifreeze, windshield wiper fluid, fuel additive, lubricant, power steering fluid, appliance fuel, multi-purpose cleaners, fabric softener, detergent, hand soap, window cleaner, bleach, ammonia, floor cleaner, carpet cleaner, weed & grass killer, insect control fluid, olive oil, vinegar, automotive paints, and the like. This cap design seals fluid within the container and can dispense liquids when turned in the upright position.

One of ordinary skill in the art will appreciate that not all dispensing caps have all these components and may have other components in addition to, or in lieu of, those components mentioned here. Furthermore, while these components are viewed and described separately, various components may be integrated into a single unit in some embodiments.

The various embodiments described above are provided by way of illustration only and should not be construed to limit the claimed invention. Those skilled in the art will readily recognize various modifications and changes that may be made to the claimed invention without following the example embodiments and applications illustrated and described herein, and without departing from the true spirit and scope of the claimed invention, which is set forth in the following claims.

What is claimed:

1. A dispensing cap connected to a container for dispensing the contents of the container, comprising:

an inner cap having a proximal end and a distal end, the proximal end includes a proximal opening and the distal end includes an inner cap opening that includes an inner funnel shaped portion having a stepped configuration, and the inner cap including a locking groove disposed in its surface; and an outer cap that is positioned over and secured to the inner cap, the outer cap having a proximal end and a distal end, the proximal end includes a proximal opening and the distal end includes an outer cap opening that includes an outer funnel shaped portion having a stepped configuration, and the outer cap includes a plurality of locking tabs that engage the locking groove disposed on the surface of the inner cap and the locking tabs disengage from the locking groove when the outer cap rotates around the inner cap;

wherein the outer cap rotates around the inner cap into an open configuration when the inner funnel shaped portion of the inner cap opening at least partially overlaps the outer funnel shaped portion of the outer cap opening allowing the contents of the container to be dispensed through the dispensing cap, wherein the size of the opening is adjustable based on the amount of overlap between the opening of the inner cap and the opening of the outer cap, and wherein the outer cap rotates around the inner cap into a closed configuration wherein the inner cap opening does not overlap the outer cap opening.

2. The dispensing cap of claim 1, wherein the inner cap and outer cap both include a generally circular shaped cross-section.

3. The dispensing cap of claim 1, wherein the inner cap and the outer cap have the same shape.

4. The dispensing cap of claim 3, wherein the inner cap has a smaller cross section than the outer cap.

5. The dispensing cap of claim 1, wherein the inner cap opening is smaller than the outer cap opening.

6. The dispensing cap of claim 1, wherein the inner cap has a generally cylindrical shape and the inner cap opening is disposed at least partially on the cylindrical side of the inner cap and at the first distal end.

7. The dispensing cap of claim 1, wherein the outer cap has a generally cylindrical shape and the outer cap opening is disposed at least partially on the cylindrical side of the outer cap and at least partially at the distal end.

8. The dispensing cap of claim 1, wherein the inner cap includes a threaded cylindrical portion that attaches to a threaded portion of the container.

9. The dispensing cap of claim 1, wherein the inner cap includes a radial rib and the outer cap includes a groove that snaps over the radial rib of the inner cap.

10. The dispensing cap of claim 1, wherein the outer cap can be rotated about the inner cap between the open configuration and the closed configuration.

11. A cap assembly connected to a container for dispensing the contents of the container, comprising:

an inner cap having a proximal end and a distal end, the proximal end includes a proximal opening, the inner cap includes a cylindrical inner cap surface between the proximal end and distal end, and the cylindrical inner cap surface includes an inner cap opening that includes an inner funnel shaped portion having a stepped configuration, and the inner cap including a locking groove disposed in its surface; and an outer cap is positioned over and secured to the inner cap, the outer cap having a proximal end and a distal end, the proximal end includes a proximal opening, and the outer cap includes a cylindrical outer cap surface between the proximal end and distal end, and the cylindrical outer cap surface includes an outer cap opening that includes an outer funnel shaped portion having a stepped configuration, and the outer cap includes a plurality of locking tabs that engage the locking groove disposed on the surface of the inner cap, and the locking tabs disengage from the locking groove when the outer cap rotates around the inner cap;

wherein the outer cap rotates around the inner cap into an open configuration when the inner funnel shaped portion of the inner cap opening at least partially overlaps the outer funnel shaped portion of the outer cap opening allowing the contents of the container to be dispensed through the cap assembly, wherein the size of the opening is adjustable based on the amount of overlap between the opening of the inner cap and the opening of the outer cap, and wherein the outer cap rotates around the inner cap into a closed configuration wherein the inner cap surface blocks the outer cap opening.

12. The cap assembly of claim 11, wherein the inner cap and outer cap both include a circular cross-section adjacent the proximal ends of the inner cap and outer cap.

13. The cap assembly of claim 12, wherein the outer cap opening is disposed at least partially on the cylindrical outer cap surface and at least partially on the distal end of the outer cap.

14. The cap assembly of claim 11, wherein the inner cap opening is disposed at least partially on the cylindrical inner cap surface and at least partially on the distal end of the inner cap.

15. The cap assembly of claim 11, wherein the outer cap can be rotated about the inner cap between the open configuration and the closed configuration.

16. A dispensing cap connected to a container for dispensing the contents of the container, comprising:

an inner cap having a proximal end and a distal end, the proximal end includes a proximal opening and the distal end includes a distal opening, the inner cap includes a cylindrical inner cap surface having a stepped configuration between the proximal end and distal end, and the cylindrical inner cap surface includes a groove; and an outer cap is positioned over and secured to the inner cap, the outer cap having a proximal end and a distal end, the proximal end includes a proximal opening and the distal end includes at least one distal opening, and the outer cap includes a cylindrical outer cap surface having a stepped configuration between the proximal end and distal end, and the distal end of the outer cap has a funnel shaped portion and the outer cap includes a plurality of locking tabs that engage the groove disposed on the surface of the inner cap, and the locking tabs disengage from the groove disposed on the surface of the inner cap when force is exerted down on the outer cap;

a seal attached to the outer cap near the at least one distal opening of the outer cap; and a spring disposed between the inner cap and the outer cap, the spring biases the outer cap away from the inner cap such that the seal completely covers the at least one distal opening of the outer cap to place the dispensing cap in a closed configuration.

17. The dispensing cap of claim 16, wherein the dispensing cap is in an open configuration when the outer cap is pressed against the spring such that the seal no longer completely covers the at least one distal opening of the outer cap.

* * * * *